United States Patent [19]

Ferneau et al.

[11] Patent Number: 4,767,148

[45] Date of Patent: Aug. 30, 1988

[54] MULTIPLE LEVEL ROLL-IN COT

[75] Inventors: Richard H. Ferneau; Robert E. Dunn, both of Wilmington, Ohio

[73] Assignee: Ferno-Washington, Inc., Wilmington, Ohio

[21] Appl. No.: 114,214

[22] Filed: Oct. 28, 1987

[51] Int. Cl.[4] ..... A61G 1/02

[52] U.S. Cl. ..... 296/20; 5/62; 5/63

[58] Field of Search ..... 296/19, 20; 5/62, 63, 5/64, 65

[56] References Cited

U.S. PATENT DOCUMENTS 3,644,944 2/1972 Bourgraf et al. ..... 296/20 X
4,097,941 7/1978 Merkel ..... 5/63 X

FOREIGN PATENT DOCUMENTS 952534 3/1964 United Kingdom .

*Primary Examiner*—Dennis H. Pedder

*Attorney, Agent, or Firm*—Frost & Jacobs

[57] ABSTRACT

A multiple level elevating cot adapted to be rolled into emergency vehicles having different floor heights, the cot having a wheeled undercarriage mounting sets of cross-forming members in which the pivot points of the cross-forming members are offset with respect to their points of intersection and at least one of each set of cross-forming members is telescopic, the cross-forming members, when in the fully elevated position, acting to incline upwardly the forward end of a cot frame mounted on the upper ends of the cross-forming members, the cot frame mounting retractable loading wheels at its forward end. The cot frame may form a part of an integral stretcher or may serve as a carrier to which a separable top structure, such as a stretcher/stair chair, may be detachably secured, the cot frame including seats for slidably receiving the top structure and latching means for securing the top structure to the cot frame.

16 Claims, 6 Drawing Sheets

MULTIPLE LEVEL ROLL-IN COT

This invention relates to ambulance cots and has to do more particularly with a multi-level roll-in cot which may be used in different types of emergency vehicles having cot receiving floors of different heights.

BACKGROUND OF THE INVENTION

A conventional ambulance cot is provided with wheels by means of which it may be moved from one place to another, including rolling the cot in and out of an emergency vehicle. In its simplest form, the cot has nonextensible wheels mounted immediately beneath the cot frame. If the cot is to be raised, it must be manually lifted by the attendants.

Several more sophisticated types of ambulance cots are available, one being a elevating type cot wherein the cot frame is mounted on collapsible legs which are arranged to collapse as the cot is placed in the emergency vehicle. Cots of this type have two positions of use, a first or "down" position in which the legs are fully collapsed, and an elevated or "up" position in which the cot frame is at a standard predetermined height for transferring the patient to a bed, operating table or the like. Since such cots have only two positions of use, situations are encountered wherein the cot frame cannot be brought into proper alignment for direct transfer of the patient from a given bed or operating table without requiring the attendants to either raise or lower the patient during transfer.

In another type of elevating cot, the collapsible legs are replaced by an undercarriage connected to the cot frame by means of pivotally mounted cross-forming braces which permitted the cot frame to be raised and lowered to a plurality of intermediate positions between its fully "down" and fully "up" positions of use. Cots of this type must be fully collapsed before being placed in the ambulance which requires the attendants to bear the full weight of the patient while the undercarriage is being collapsed. To overcome this problem, some cots are provided with an extra set of loading wheels projecting forwardly from the cot frame by means of which the forward or head end of the cot may be supported on the floor of the emergency vehicle while the undercarriage is moved to the fully collapsed position. While useful, such additional wheels form obstructions which can impede the maneuverability of the cot in close quarters.

In another type of cot construction, the cot is provided with a base structure which serves as a carrier for a removable stretcher top, thereby providing a multiple purpose cot which can be used either as a conventional ambulance cot, or the stretcher top detached for separate use and reattached to the carrier prior to loading into the emergency vehicle.

While each of the foregoing cots possesses certain desirable features, they also have deficiencies due to the fact that they are designed for specific purposes. A need has arisen for a more versatile ambulance cot which provides a multiplicity of features not heretofore obtainable in a single cot, with particular reference to the ability of the cot to be readily loaded into various types of rescue vehicles, such as ambulances, vans, station wagons, or modular type rescue vehicles having widely differing floor heights.

SUMMARY OF THE INVENTION

In accordance with the present invention, a cot construction is provided having a stable undercarriage to which a cot frame is attached by pairs of cross-forming frame members which permit the cot frame to be raised and lowered to a plurality of positions of use. In order to expand the ability of the cot to be rolled into different types of emergency vehicles, one of the cross-forming frame members in each pair is extensible, being provided with a telescoping extension. In addition, the pivot points of the pairs of cross-forming members are offset relative to their points of intersection so as to retain maximum strength of the cross-forming frame members and maintaining the desired frame relationship during raising and lowering of the cot. Such arangement permits the leading end of the cot frame to be inclined upwardly when in the elevated position, so that the cot may be rolled directly into vehicles having unusually high floor levels.

In order to facilitate the rolling of the cot directly into the vehicle, the cot frame is provided with loading wheels at its leading end which may be collapsed for better maneuverability in tight areas. Associated with the loading wheels are means for releasably locking the cot to an anchor in the floor of the emergency vehicle In one embodiment of the invention, the top of the cot is integral with the undercarriage and may be provided with an adjustable backrest and also an adjustable leg section for patient comfort and to assist in patient treatment.

In another embodiment of the invention, the cot frame is provided with a removable top structure which is detachably secured to the cot frame and which, in a preferred embodiment, may be converted from a stretcher to a stair chair, the removable top permitting easy maneuverability in emergency situations and also serving to reduce the number of patient transfers.

Where a removable top structure is provided, the cot is provided with locking mechanism which automatically locks the removable top to the cot frame when the top is seated on the frame, readily accessible release means being provided to permit rapid detachment of the top from the cot frame.

DESCRIPTION OF THE PREFERRED EMBODIMENTS

Figure 1:
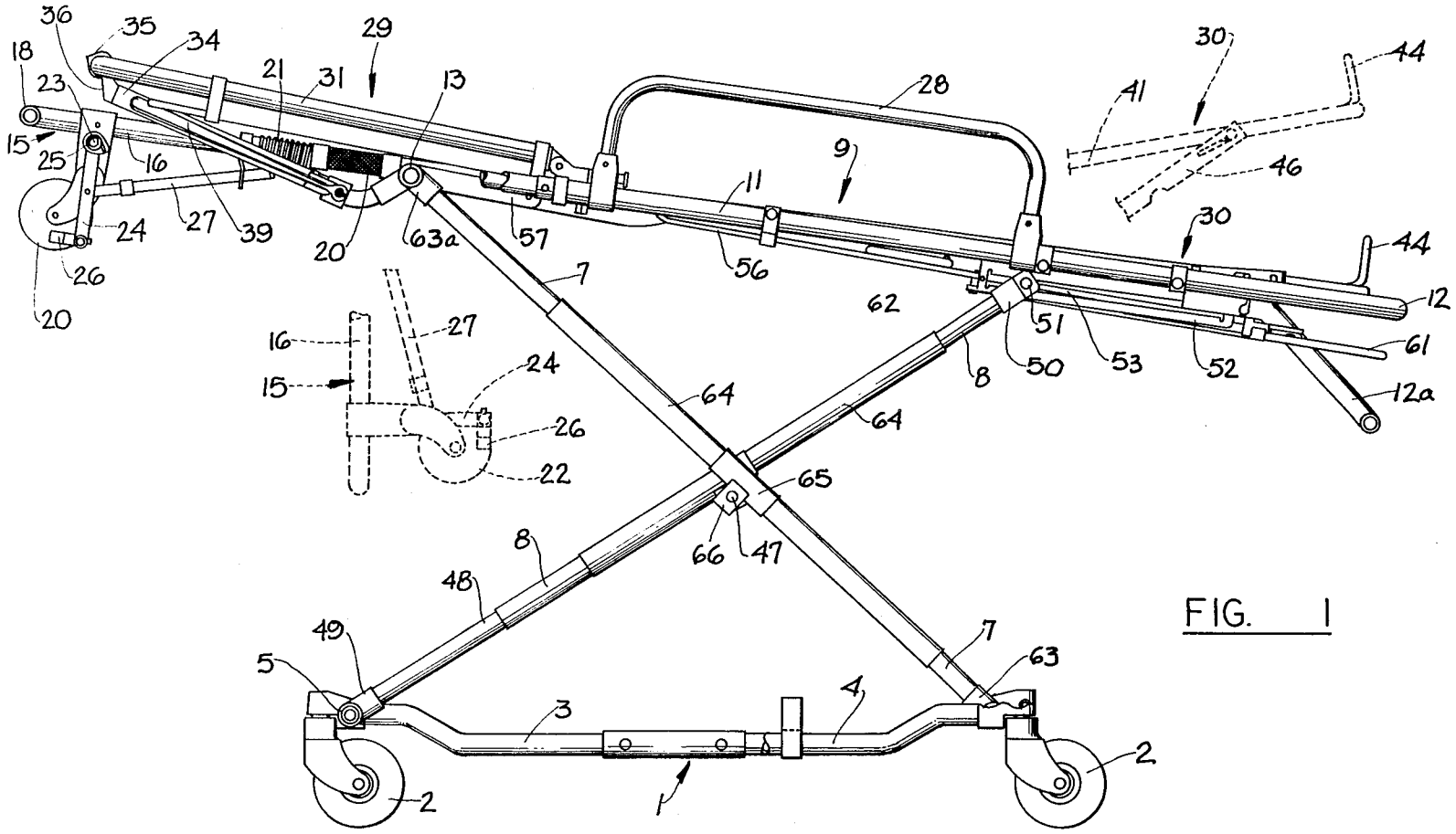
FIG. 1 is a side elevational view of a first embodiment of the invention incorporating an integral top, with parts broken away and others in dotted lines for purposes of illustration.
Figure 2:
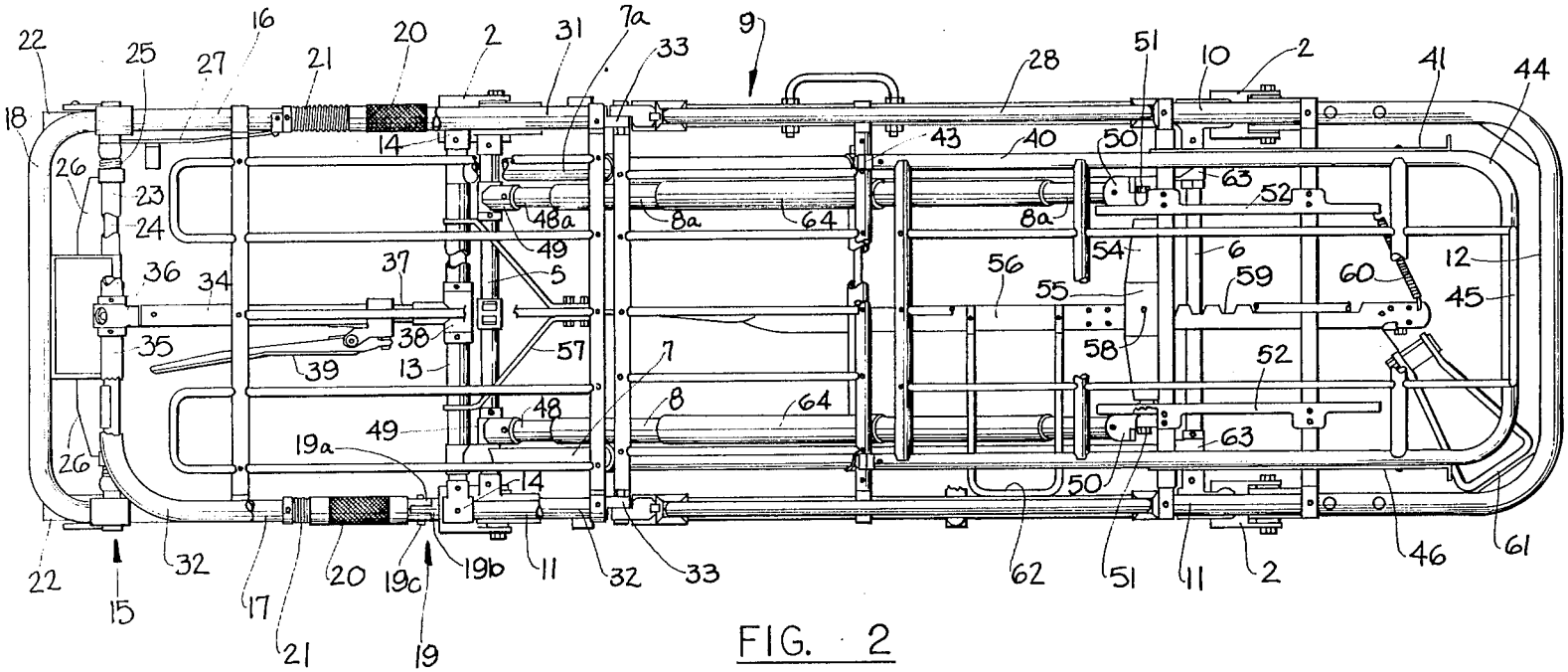
FIG. 2 is a top plan view of the embodiment of FIG. 1 with parts broken away to show underlying parts.

Referring first to FIGS. 1 and 2 which relate to a cot structure having an integral top structure, the cot has a rectangular undercarriage 1 mounting pairs of caster wheels 2 at its opposite ends, the undercarriage having opposing side frame members 3 and 4 interconnected by transverse frame members 5 and 6, the latter being best seen in FIG. 2. Extending upwardly from the undercarriage 1 are pairs of cross-forming frame members 7, 8 and 7*a*, 8*a* which serve to interconnect the undercarriage 1 with a cot frame 9 which, in the embodiment illustrated, comprises opposing tubular side frame members 10 and 11 interconnected at the foot or trailing end by a transverse tubular end member 12. At their leading or forward ends the side rails 10 and 11 terminate at a transverse frame member 13 connected at its opposite ends to the side rails 10 and 11 by fittings 14.

At its forward end, the cot frame is provided with a collapsible extension, indicated generally at 15, having tubular side frame portions 16 and 17 joined at their forward ends by an end frame member 18. The side frame sections 16 and 17 are pivotally connected to the side frame members 10 and 11, respectively, by bifurcated hinges 19, one of which is seen in FIG. 2, the hinges each having a bifurcated part 19*a* which receives a tongue part 19*b*, the parts being connected together by a pivot pin 19*c*, the hinges being oriented to permit the collapsible section 15 to be moved from the extended position seen in FIGS. 1 and 2 to the collapsed position shown in dotted lines in FIG. 1. The extensible section 15 is adapted to be locked in the extended position by means of the knurled sleeves 20 which surround the side frame sections 16 and 17, the sleeves 20 normally surrounding the bifurcated hinges to thereby lock the hinges and the collapsible section 15 in the extended position. The sleeves 20 are displaceable axially against the compression of springs 21 to expose the bifurcated hinges 19, thereby freeing the extensible section 15 for pivoting movement to the collapsed condition shown in dotted lines.

The collapsible section 15 is provided with a pair of loading wheels 22 projecting downwardly from the outermost ends of side frame sections 16 and 17, the wheels being interconnected by a rod 23 mounting a generally U-shaped tubular bail 24 which is spring biased to the downwardly extending position seen in FIG. 1 by means of springs 25, the bail being provided along its lowermost surface with spaced apart guides 26 adapted to receive therebetween a tongue-like floor fitting (not shown) mounted on the floor of the emergency vehicle which engages the bail 24 between the guides 26. The bail 24 is adapted to pivot rearwardly against the compression of springs 20 so that it will pass over the floor fitting when the cot is placed in the emergency vehicle; and the bail 24 also may be deflected upwardly by means of the release arm 27 positioned adjacent one side of the cot frame, which permits the attendant to release the bail from engagement with the floor fitting when it is desired to remove the cot from the vehicle.

It will be understood that the basic cot frame 9 may be provided with various adjustable features, such as folding side arms 28, a multiple-position backrest, indicated generally at 29, and an adjustable leg section for placing the patient in a shock position, indicated generally at 30, all of which are conventional features. The backrest 29 has opposing side frame members 31 and 32 hingedly connected at their innermost ends to the side frame members 10 and 11, respectively, by means of pivot fittings 33. The backrest 29 is adapted to be raised and lowered relative to the cot frame by means of tubular brace 34 (best seen in FIG. 2) which is pivotally connected at its outermost end to the end frame member 35 of the backrest section 29, the end frame member 25 extending between the opposing side members 31 and 32. The tubular brace 34 is connected to end frame member 35 by means of an irregularly shaped T-bracket 36. At its opposite end, the tubular brace 34 telescopically receives a coacting brace member 37 the protruding end of which is rotatably connected to the transverse frame member 13 by means of an irregularly shaped T-bracket 38. Brace member 34 also mounts a latch arm 39 which is adapted to engage the brace member 37 as it is withdrawn from the brace member 34 upon elevation of the backrest section, thereby permitting the backrest section to be latched in various inclined positions of use. To this end, the latch member may be provided with a displaceable pin adapted to selectively engage spaced apart perforations in the brace member.

The adjustable leg section 30 has opposing side frame members 40 and 41 hingedly connected at their inner ends to a transverse bracket 42 by means of hinge members 43, as seen in FIG. 2. At their opposite ends the frame members 40 and 41 terminate in an integral transverse frame member 44 on which a footrest 45 is mounted, the footrest section being adapted to be raised and lowered by means of latch members 46 of known construction. In this connection, it will be understood that the various components of the cot frame 9, such as the folding side arms 28, the multiple position backrest 29 and the adjustable leg section 30 are of conventional construction and may take different forms. Other conventional features also may be provided, such as an auxiliary bail-like end frame member 12*a* underlying end frame member 12, which is positioned to be easily grasped by an attendant.

In accordance with the invention, the pairs of cross-forming frame members 7, 8 and 7*a*, 8*a* are pivotally connected intermediate their ends by means of a pivot rod 47 which is offset downwardly with respect to the point of intersection of the pairs of cross-forming frame members 7, 8 and 7*a*, 8*a*. In addition, the cross-forming frame members 8, 8*a* telescopically receive tubular extensions 48, 48*a* at their lowermost ends which are pivotally connected to the transverse frame member 5 by means of T-shaped fittings 49. At their uppermost ends the cross-forming frame members 8, 8*a* mount fittings 50 having guide pins 51 slidably received in elongated guide members 52 each provided with an elongated pin receiving slot 53, one of which is seen in FIG. 1. The pins 52 are interconnected by a stabilizer 54 (seen in FIG. 2), the stabilizer having a hollow passageway 55 which loosely receives an elongated locking bar 56. The locking bar is connected at one end to a yoke 57 pivotally mounted on the transverse frame member 13, the locking bar being twisted through substantially 90° intermediate its ends so as to provide a vertically disposed portion in engagement with the yoke 57 and a horizontally disposed portion extending through the passageway 55 in stabilizer 54, the passageway having a latch pin 58 extending vertically therethrough for selective engagement with a series of notches or teeth 59 formed in the locking bar 56. A spring 60 is positioned to urge the notches in the locking bar into engagement with the pin 58. The locking bar may be displaced laterally by means of loop-like release members 61 and 62 positioned to be grasped by the cot attendant either at the forward end of the cot or along one side thereof.

The lowermost ends of the cross-forming frame members 7, 7*a* are pivotally connected to transverse frame member 6 of the undercarriage by means of fittings 63, and at their uppermost ends the cross-forming frame members 7, 7*a* are pivotally connected to the transverse frame member 13 of the cot frame by fittings 63*a*. It also may be noted that the cross-forming frame members may be reinforced intermediate their ends by sleeves 64 and tubular sections 65 which have depending ears 66 which mount the downward offset pivot rod 47.

With the arrangement just described, the cot frame 9 may be collapsed against the undercarriage 1 by releasing the locking bar 56 and permitting the cross-forming frame members 8, 8*a* to move to the outermost ends of the slots 53 in the elongated brackets 52, coupled with the telescoping of the extensible sections 48, 48*a* within the lowermost ends of cross-forming members 8, 8*a*. As the cot is elevated, the sets of cross-forming frame members will elevate the cot frame relative to the undercarriage in a generally horizontal plane. However, as the fully elevated positions of the cot frame is approached, i.e., such as the two innermost notches on the locking bar 56, the cot frame 9 will be inclined upwardly at its leading end, as illustrated in FIG. 1, by reason of the extensible cross-forming frame members 48, 48*a* and the offset relation of the pivot rod 47 to the points of intersection of the pairs of frame mebers 7, 8 and 7*a*, 8*a*, thereby elevating the loading wheels 22 to a higher position than if the cot frame remained horizontal and permitting the transfer of the cot into an emergency vehicle having an unusually high floor level.

Figure 3:
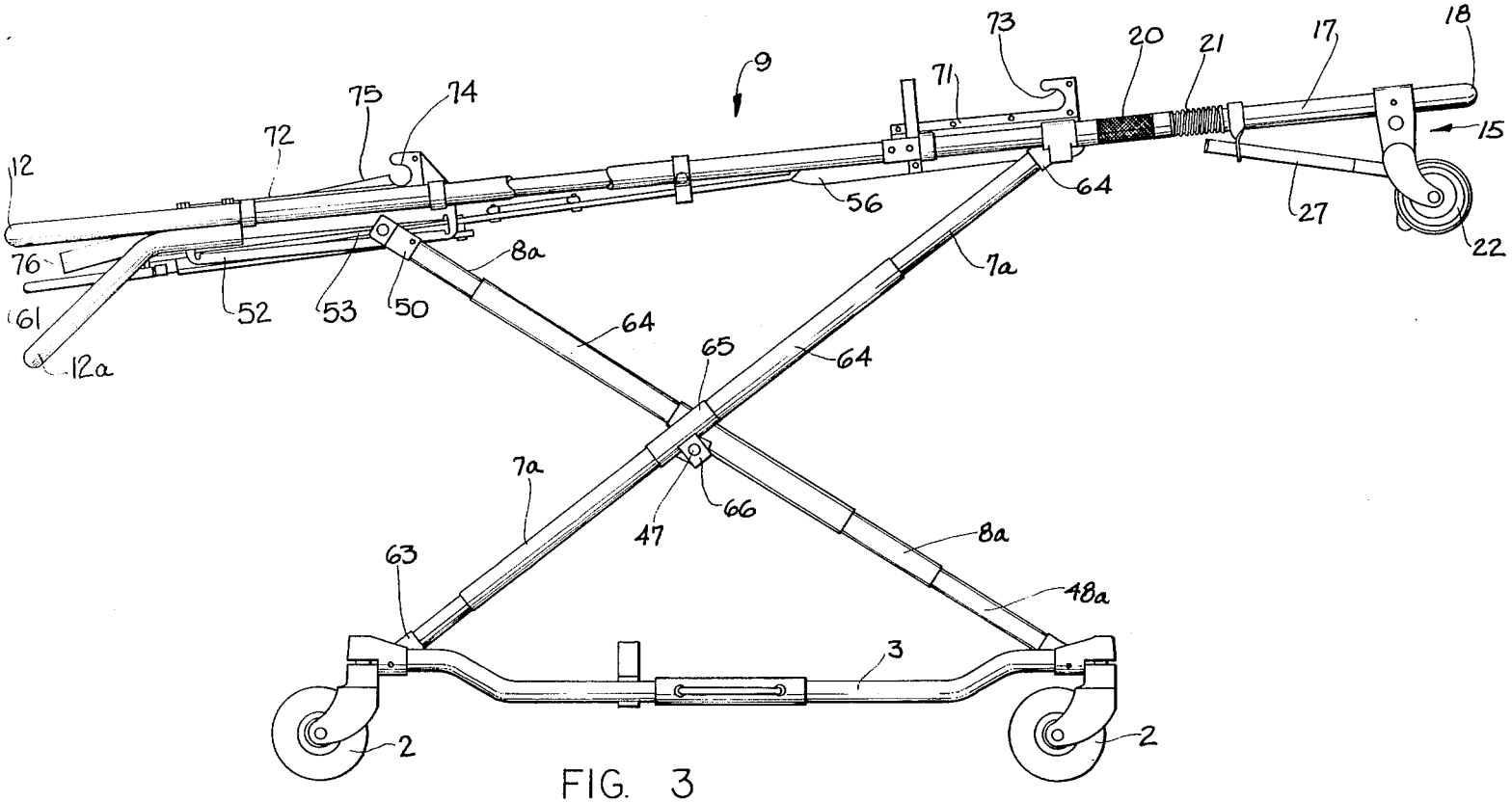
FIG. 3 is a side elevational view of a modification of the invention wherein the cot frame is adapted to mount a removable top, with parts broken away for purposes of illustration.
Figure 4:
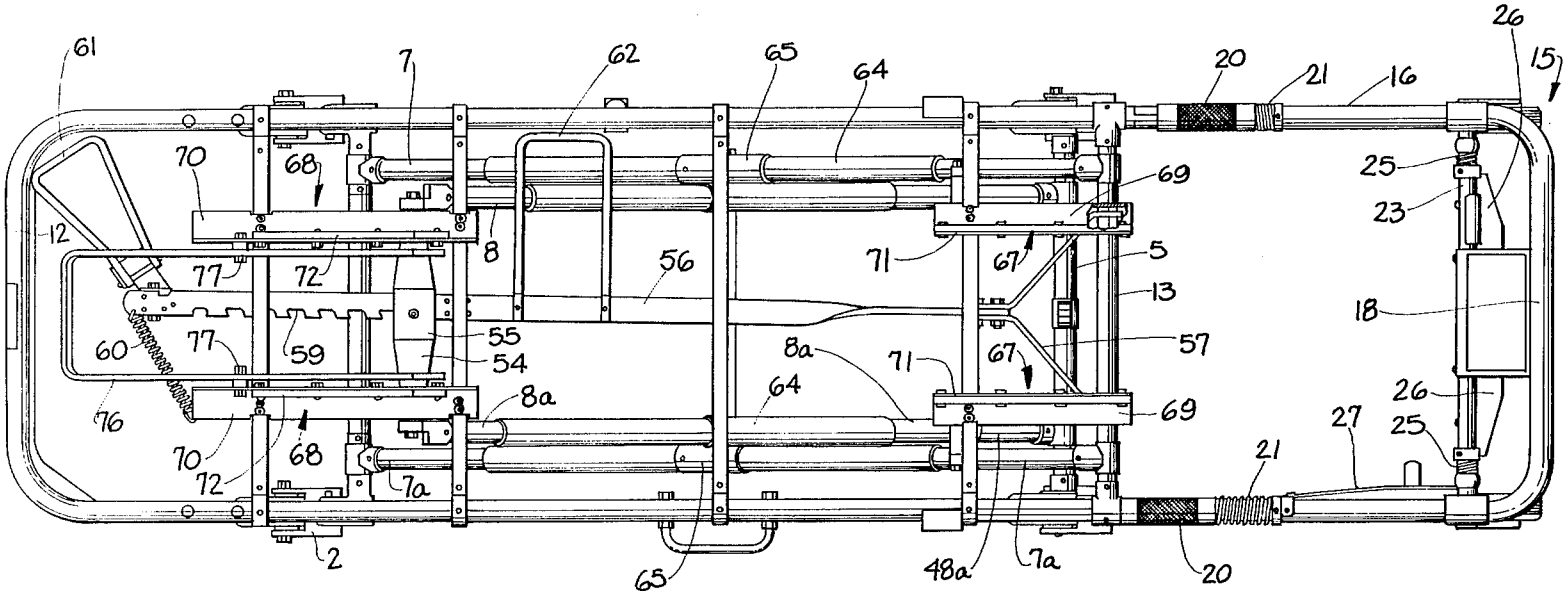
FIG. 4 is a top plan of the embodiment of FIG. 3 also with parts broken away to illustrate underlying parts.
Figure 5:
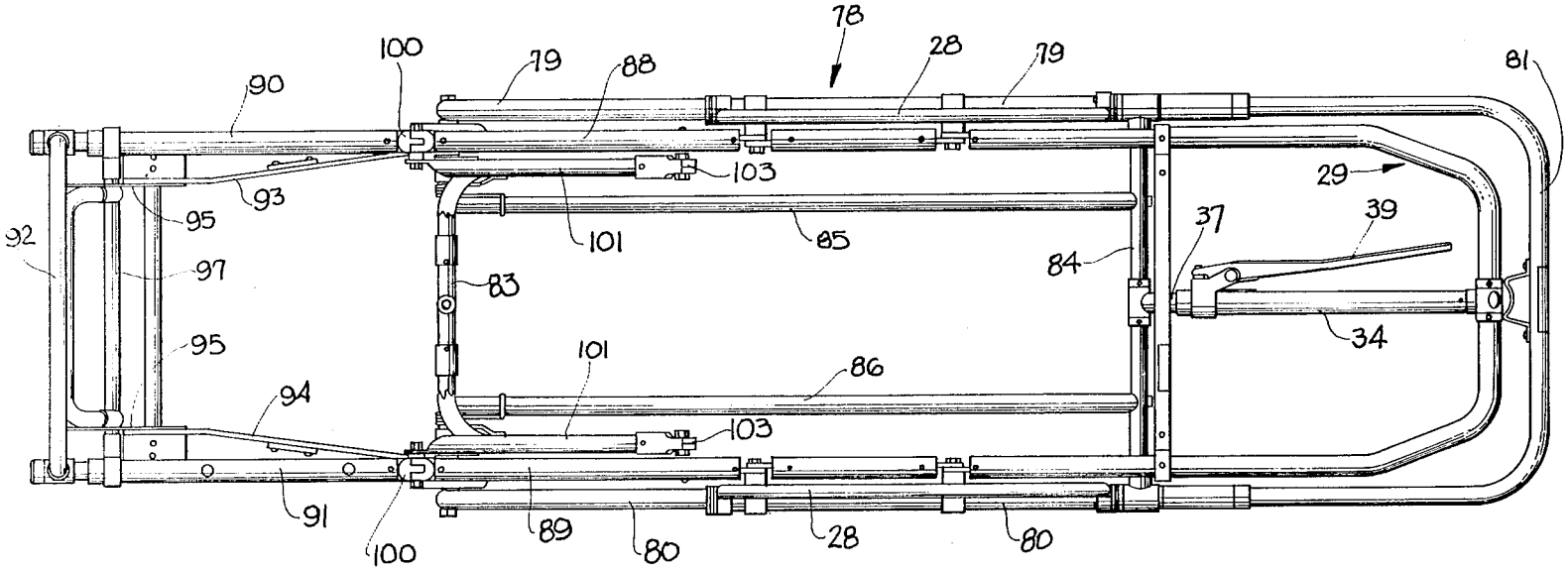
FIG. 5 is a plan view of a removable top in the form of a stretcher/stair chair, with parts broken away to illustrate underlying structures.
Figure 7:
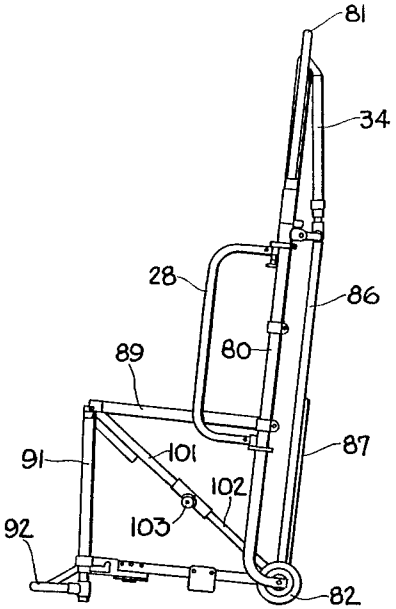
FIG. 7 is a side elevational view of the device in its position of use as a stair chair.
Figure 6:
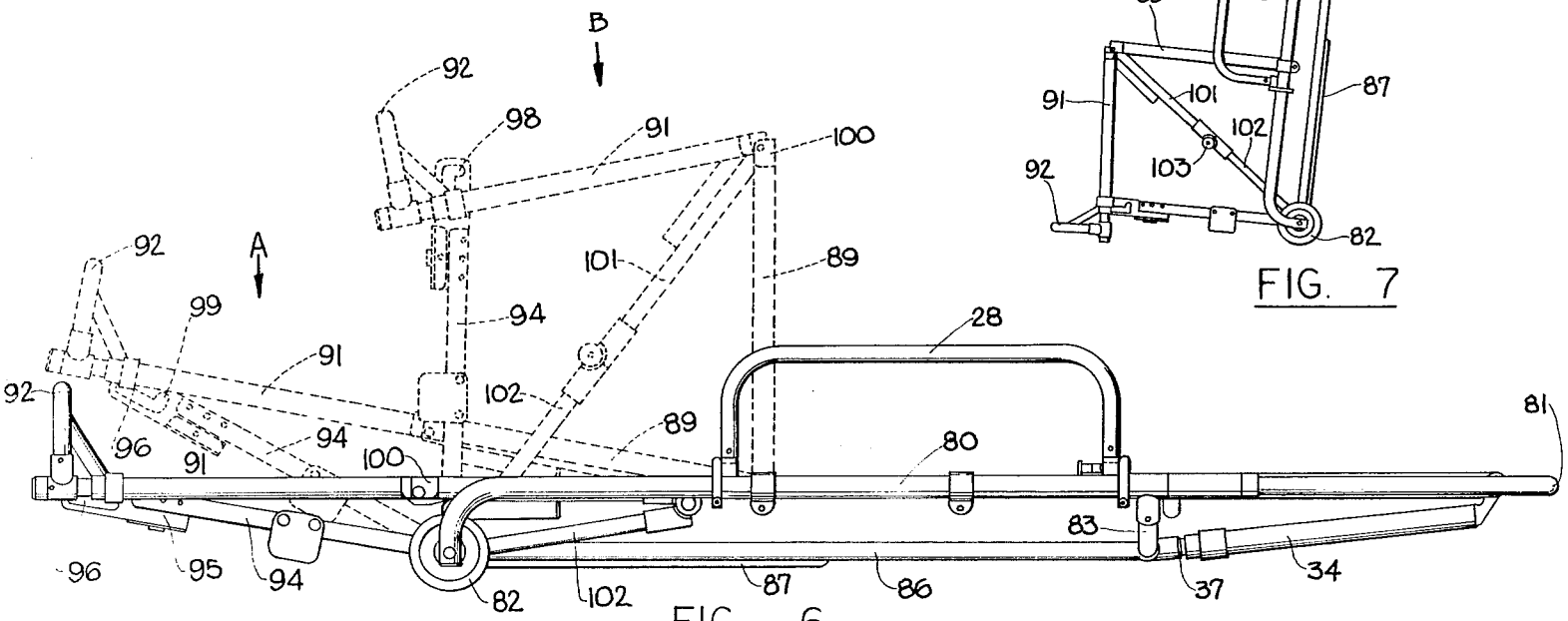
FIG. 6 is a side elevational view of the stretcher/stair chair of FIG. 5, with alternative positions of the parts shown in dotted lines.

Referring next to FIGS. 3 and 4 of the drawings, there is illustrated an embodiment of the invention wherein the cot frame 9 is adapted to receive a removable top, such as the stretcher/chair stair illustrated in FIGS. 5–7. It will be understood that the undercarriage of the embodiement of FIGS. 3 and 4, as well as the construction and operation of the cross-forming frame members is identical to that described in FIGS. 1 and 2, as are the basic components of the cot frame, including the collapsible section 15 at the leading end of the cot frame, the loading wheels associated therewith, and the mechanism associated with the elongated locking bar 56 which permits the cot frame to be raised and lowered relative to the undercarriage. To this end, like parts have been given like reference numerals. It may be further noted that in the embodiment of FIGS. 3 and 4, the cot frame does not incorporate the various adjustable features forming a part of the cot frame of FIGS. 1 and 2, such as the folding side arms, the multiple position backrest and the adjustable leg section.

As best seen in FIG. 4, the cot frame is provided with leading and trailing sets of seats 67 and 68 adapted to receive correspondingly positioned frame members of the removable top. The seats 67 and 68 have horizontally disposed pairs of supporting plates 69, 70, respectively, together with pairs of vertically disposed brackets 71, 72. As seen in FIG. 3, the brackets 71 have C-shaped openings 73 therein. The brackets 72 also have C-shaped openings, indicated at 74, but in this instance they are preceded by inclined cam rails 75 which, as will be explained in greater details hereinafter, serve to lock transversely extending frame members of the removable top in the slots 74 until they are lifted from the slots by a U-shaped latch 76, seen in FIG. 4, which is pivotally connected intermediate its ends to the brackets 72 by means of pivot pins 77. The distal ends of latch 76 underlie the C-shaped opening 74 in the vertically disposed brackets 72, and when the bail end of the latch is depressed the distal ends of the latch will be elevated to permit the transverse frame member of the removable top to clear the abutments defined by the cam rails 75, thereby releasing the transverse frame member and permitting the removable top to be separated from the cot frame.

Referring next to FIGS. 5–7 which illustrate a preferred form of removable top, the top structure in this embodiment comprises a stretcher-stair chair, indicated generally at 78, the structure having opposing side frame members 79 and 80 terminating at the head or leading end in a transverse end frame member 81. At their opposite ends the side frame members turn downwardly and support an opposing pair of wheels 82 interconnected by a transverse frame member 83, seen in FIG. 5. A similar transverse frame member 84 extends between and interconnects the opposing side frame members 79 and 80 intermediate their opposite ends, the transverse frame members 83 and 84 being spaced downwardly from the plane defined by the side frame members 79, 80. A pair of longitudinally extending frame members 85 and 86 extend between the transverse frame members 83, 84 and are spaced apart by a distance such that they will overlie and contact the sets of seats 67, 68 of the cot frame (seen in FIG. 4). To this end, and as seen in FIG. 6, the longitudinal frame members may be provided with skids 87 to facilitate sliding movement of the longitudinal frame members 85 and 86 relative to the seats to facilitate engagement of the transverse frame members 83 and 84 with the C-shaped openings 74 and 73, respectively, in the vertically disposed brackets 71 and 72 forming part of the sets of seats 68, 69.

It will be understood that the removable top, irrespective of whether it is a simple stretcher, a stretcher/-stair chair or other form of cot, will be provided with opposing longitudinal frame members 85, 86 arranged to be seated on and secured to the sets of seats 67, 68 of the cot frame.

In the embodiment illustrated, the opposing side rail members 79 and 80 pivotally mount a seat forming section having opposing side frame members 88 and 89 to which side frame members 90, 91 of the leg supporting section are hingedly connected, the frame members 90, 91 being interconnected at their outermost ends by an extensible footrest section, indicated generally at 92. The leg supporting section is also provided with a pair of adjustable brackets 93, 94 by means of which the seat and leg rest sections may be jointly elevated to the position shown in dotted lines at A in FIG. 6, the brackets having fittings 95 at their forward ends including elongated slots 96 engageable about a cross rod 97 extending between the opposing leg supporting frame members 90, 91. The slots 96 have rod engaging notches 98 and 99 at their opposite ends adapted to selectively engage the cross rod 97, the seat and leg supporting sections being maintained in the inclined position illustrated at A in FIG. 6 when the notches 98 at the outermost ends of the slots 96 are in engagement with the cross rod 97.

The seat and leg supporting sections are movable to the alternate position of use indicated in dotted lines at B in FIG. 6, and also shown in FIG. 7, when the stretcher is converted to a stair chair. To this end, the opposing sets of frame members 88, 89 and 90, 91 pivot relative to each other about the hinges 100 which permit the sets of side frame members to pivot relative to each other from the extended position shown at A in FIG. 6 to the seat forming position shown at B and also in FIG. 7, the construction of the hinges being such that the side frame members cannot move relative to each other in a downward direction beyond their extended position. The hinges permit pivotal movement of the frame members from the position shown at A to the position shown at B, and when in the B position the frame members 88, 89 are fixed relative to the frame members 90, 91 by means of the sets of diagonal braces 101, 102 hingedly connected together by hinges 103 which act to fix the braces in the extended position, but permit them to collapse so that the sets of side rail members 88, 89 and 90, 91 may be moved to the fully extended position shown at A. When in the stair chair position, the adjustable brackets 93 and 94 lock the leg section frame members 90, 91 in fixed position, the notches 99 at the inner ends of slots 96 engaging the cross rod 97. As will be evident from FIG. 7, when in the stair chair position, the back of the stair chair rests on the wheels 82 and the ends of the footrest section 92, and the chair so formed may be wheeled from place to place by tilting the back of the chair rearwardly.

As also will be evident from FIGS. 6 and 7, the removable top structure may be provided with additional appurtenances, such as folding side arms 28 and a multiple position backrest 29 adapted to be raised and lowered by means of telescoping tubular members 34 and 37 and latch arm 39, as previously described in conjunction with the embodiment of FIGS. 1 and 2.

The removable top structure may be fitted to the underlying cot frame by sliding it forwardly along the cot frame with the longitudinal frame members 85 and 86 in sliding contact with the horizontal plates 69 and 70 of the seats 67 and 68. Forward movement will stop when the transverse frame member 84 engages the C-shaped openings 73 in the brackets 71. At the same time, the trailing transverse frame member 83 will have traveled along the inclined cam rails 75 and dropped into the C-shaped openings 74 forming a part of seats 68, thereby effectively securing the top structure to the underlying cot frame when it is desired to remove the top structure for independent use, the operator will depress the outer bail end of the V-shaped latch 76, such movement causing the digital ends of the latch to move upwardly, thereby lifting the transverse frame member 83 of the top structure so that it will clear the ends of the cam rails 75, whereupon the top structure may be moved rearwardly to disengage the transverse frame members from the C-shaped opening, whereupon the top structure may be lifted from the underlying cot frame.

What is claimed is:

1. An elevating cot adapted to be rolled into emergency vehicles having different floor heights, said cot comprising:

a rectangular undercarriage having a leading end and a trailing end, caster wheels affixed to said undercarriage, a generally rectangular cot frame overlying said undercarriage, said cot frame having a leading end and a trailing end, and a pair of loading wheels mounted on the leading end of said cot frame, coacting pairs of complementary cross-forming frame members extending between and interconnecting said cot frame and said undercarriage, each of said pairs of frame members comprising a first frame member of fixed length and a second frame member having an extensible section at its lowermost end, the frame members in each pair being pivotally connected together intermediate their opposite ends by pivot means which are offset with respect to a point of intersection of each of said respective pairs, the first frame members of each pair being rotatably connected at their lowermost ends to opposite sides of said undercarriage at the trailing end thereof, the second frame members of each pair having their extensible sections rotatably connected at their lowermost ends to opposite sides of said undercarriage at the leading end thereof, the uppermost ends of said first frame members being rotatably connected to opposite sides of said cot frame toward the head end thereof, bracket means on the opposite sides of the cot frame toward the trailing end thereof, said bracket means extending lengthwise of the cot frame and each having an elongated slot therein, slot engaging means at the uppermost ends of said second frame members slidably mounting the second frame members to the cot frame, whereby as the cot frame is elevated relative to said undercarriage it will assume at least one elevated position in which the cot frame is inclined upward in the direction of its leading end so that the loading wheels on the cot frame may be positioned to enter an emergency vehicle having a high floor level, and latching means for selectively securing said cross-forming members in a plurality of predetermined positions of use.

2. The cot structure claimed in claim 1 wherein said cot frame has a movable section at its leading end mounting said loading wheels, said movable section being hingedly connected to the cot frame for movement from an extended position in which the movable section lies in prolongation of the cot frame to a collapsed position in which it extends vertically downwardly from the cot frame, and locking means securing said movable section in its extended position.

3. The cot structure claimed in claim 2 wherein said cot frame includes tubular side rails, wherein said movable section includes mating tubular side rails, hinge means pivotally connecting the side rails of said movable section to the side rails of said cot frame, said hinge means comprising a bifurcated member adapted to be secured to one of the side rail members being joined and a tongue adapted to be secured to the other side rail member being joined, the tongue being inserted in the bifurcated part and pivotally connected thereto by a pivot pin, and wherein said locking means comprises a sleeve slidably surrounding said side rails in the area of said hinge, said sleeve acting to maintain said hinge parts in fixed position when said hinge parts are surrounded by said sleeve, said sleeve being axially displaceable along one of said side rails to free said hinge parts for pivotal movement.

4. The cot structure claimed in claim 2 including anchoring means mounted on the movable section of said cot frame, said anchoring means being releasably engageable with a complementary cot anchoring means mounted on the floor of the emergency vehicle.

5. The cot structure claimed in claim 4 wherein said anchoring means comprises a generally U-shaped anchoring member positioned between said loading wheels and pivotally connected to the movable section of the cot frame, said U-shaped member being movable from an anchoring position in which it extends downwardly between said loading wheels to an elevated release position, spring means normally biasing said anchoring member to its anchoring position, and lever means for moving said anchoring member to its release position.

6. The cot structure claimed in claim 1 wherein said latching means comprise an elongated latching bar pivotally secured at one end to said cot frame, said latching bar having a plurality of spaced apart notches therein, notch engaging means operatively connected to the slot engaging means at the uppermost ends of said second frame member for selectively engaging the notches in said elongated latching bar to thereby establish the elevated position of the cot frame relative to said undercarriage.

7. The cot structure claimed in claim 6 wherein the dimensioning of the parts is such that at least one endmost notch on the latching bar will position the cot frame in an inclined position in which its leading end is elevated relative to its trailing end.

8. The cot construction claimed in claim 1 in combination with a removable top adapted to be seated on said cot frame, said removable top including longitudinally extending frame members adapted to seat on said cot frame, said cot frame having forward and rearward pairs of seats positioned to receive the longitudinally extending frame members of said removable top, said removable top also including laterally extending frame members positioned to overlie the pairs of seats on said cot frame, bracket means in association with said seats positioned to releasably engage said laterally extending frame members, and securing means for releasably securing said laterally extending frame members to said last named bracket means.

9. The cot construction claimed in claim 8 wherein said seats comprise horizontally disposed plates along which the longitudinal frame members of said removable top are adapted to slide, wherein said last named bracket means are vertically disposed and lie adjacent said seats, said bracket means having Cshaped openings therein positioned to receive the lateral frame members of said removable top when the top is moved in the direction of the leading end of said cot frame, and wherein said securing means comprises a pair of arms pivotally connected to said cot frame adjacent one of the sets of seats and positioned to releasably engage the corresponding laterally extending frame member of the removable top.

10. The cot construction claimed in claim 9 wherein pivotal movement of said arms acts to displace the laterally extending frame members of the removable top from the C-shaped openings in said last named brackets.

11. The cot construction claimed in claim 10 wherein said removable top comprises a stretcher/stair chair.

12. The cot construction claimed in claim 11 wherein said stretcher/stair chair comprises an opposing pair of side frame members, said laterally extending frame members of said removable top extending between and interconnecting said opposing pair of side frame members, the said longitudinally extending frame members of said removable top being secured to said laterally extending frame members and lying between said opposing pair of side frame members.

13. The cot construction claimed in claim 12 wherein said laterally extending frame members are displaced downwardly relative to the plane of said opposing pair of side frame members, whereby said longitudinally extending frame members underlie said opposing pair of side frame members and are spaced downwardly relative to back rest, seat and leg supporting sections of said stretcher/stair chair.

14. The cot construction claimed in claim 11 wherein said stretcher/stair chair comprises an opposing pair of side frame members, a seat forming section pivotally connected to said opposing side frame members intermediate their opposite ends, a leg supporting section pivotally connected to said seat forming section, said seat forming section and leg supporting section being movable relative to each other from a planar position in which they extend in parallel relation to said opposing side frame members to an elevated position in which they lie in angular relation to each other, and diagonal brace means extending between said side frame members and an outermost end of said seat forming section, said diagonal brace means being in an extended position when said seat forming and leg supporting sections are in their elevated position and in a collapsed position when said seat forming and leg supporting sections are in their planar position.

15. The cot construction claimed in claim 14 including adjustable bracket means for jointly raising said seat and leg supporting sections to an inclined position relative to said side frame members, said adjustable brackets also serving to lock the seat and leg supporting sections in their elevated position.

16. The cot construction claimed in claim 15 including a back rest section pivotally connected to said opposing side frame members adjacent said seat forming section, and adjustment means for raising and lowering said back rest section relative to said opposing side frame members.

* * * * *